US005346301A

United States Patent [19]

Scarberry et al.

[11] Patent Number: 5,346,301

[45] Date of Patent: Sep. 13, 1994

[54] RECLOSABLE BAG WITH OFFSET END SEAL

[75] Inventors: Paul W. Scarberry, N51 WI6838 Fair Oak Pkwy., Menomonee Falls, Wis. 53051; Barrie A. Bray, Brown Deer, Wis.

[73] Assignee: Paul W. Scarberry, Menomonee Falls, Wis.

[21] Appl. No.: 41,752

[22] Filed: Apr. 2, 1993

[51] Int. Cl.[5] ..... B65D 33/18

[52] U.S. Cl. ..... 383/5; 383/37; 383/93; 383/204; 206/807

[58] Field of Search ..... 383/5, 63, 65, 93, 44, 383/204, 207, 211, 67, 37, 203; 206/807

[56] References Cited

U.S. PATENT DOCUMENTS

| | | | |
|---|---|---|---|
| 3,613,874 | 10/1971 | Miller . | |
| 4,355,494 | 10/1982 | Tilman | 53/416 |
| 4,468,811 | 8/1984 | Shaw | 383/5 |
| 4,484,352 | 11/1984 | Katzin | 383/65 |
| 4,502,599 | 3/1985 | Perecman | 206/554 |
| 4,892,414 | 1/1990 | Ausnit | 383/63 |
| 4,932.791 | 6/1990 | Vetter | 383/5 X |
| 4,986,673 | 1/1991 | Bell | 383/63 X |
| 5,077,064 | 12/1991 | Hustad et al. | 383/5 X |
| 5,121,997 | 6/1992 | La Pierre et al. | 383/65 X |
| 5,224,779 | 7/1993 | Thompson et al. | 383/5 |

FOREIGN PATENT DOCUMENTS

| | | | |
|---|---|---|---|
| 373748 | 6/1990 | European Pat. Off. | 383/5 |

*Primary Examiner*—Sue A. Weaver

*Attorney, Agent, or Firm*—Charles F. Meroni, Jr.

[57] ABSTRACT

The closable bag with offset end seal comprises a layer of plastic folded over itself to create an elongate strip of interconnected pockets which are separable from one another along the strip to create individual bags. Interposed between free overlying ends of the plastic strip is a gasket made of a heat sealable material having a low surface tension and coefficient of friction. A side edge of these three layers is heat sealed and scored to provide a tamper indicating strip which must be removed to open the bag. Slightly lateral to this strip is a section of the bag where the gasket is heat sealed along its length to one of the layers of plastic, with a remaining inwardly extending portion of the gasket being free to move away from the layer to which it sealed, creating an inwardly directed flap. On a surface of the unattached layer of plastic facing the gasket are provided two spaced apart longitudinal strips of adhesive which cause engagement between the layer of plastic and the gasket flap. Thus, if product within the bag moves toward the seal end of the bag, it rests between the gasket flap and the layer of plastic to which it is heat sealed, without directly resting against the area of closure and compromising effectiveness thereof.

15 Claims, 3 Drawing Sheets

FIG. 1
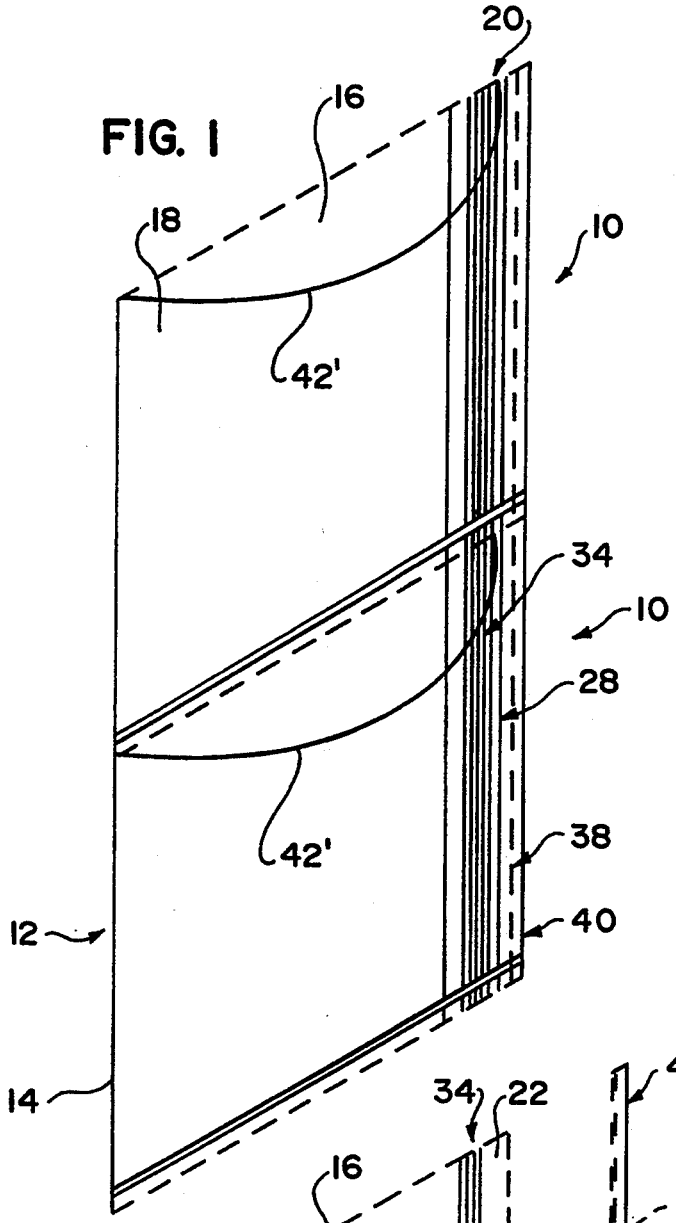
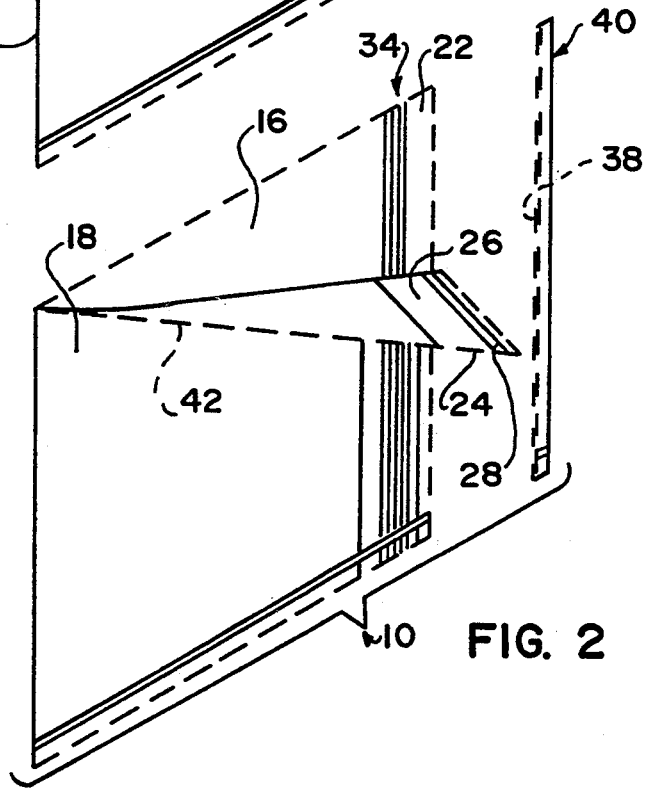
FIG. 2

RECLOSABLE BAG WITH OFFSET END SEAL

BACKGROUND OF THE INVENTION

1. Field of the Invention

The present invention relates generally to the automated flexible packaging art. More specifically, the invention relates to a flexible package having improved reclosability and reduced waste in seal areas of the package.

2. Description of the Prior Art

The prior art is replete with examples of reclosable packages which are created as strips of interconnected bags by automated packaging machines.

Examples of such art are found in the following U.S. Patents:

| U.S. Pat. No. | Patentee |
|---|---|
| 3,420,433 | Bostwick |
| 3,613,874 | Miller |
| 3,942,713 | Olson et al. |
| 3,990,627 | Olson |
| 4,235,653 | Ausnit |
| 4,249,982 | Ausnit |
| 4,285,376 | Ausnit |
| 4,290,467 | Schmidt |
| 4,348,440 | Kriozere |
| 4,355,494 | Tilman |
| 4,441,613 | Hain et al. |
| 4,468,811 | Shaw et al. |
| 4,502,599 | Perecman |
| 4,528,224 | Ausnit |
| 4,581,007 | Kamp |
| 4,582,549 | Ferrell |
| 4,584,201 | Boston |
| 4,617,683 | Christoff |
| 4,655,862 | Christoff et al. |
| 4,691,373 | Ausnit |
| 4,706,297 | Ausnit |
| 4,709,533 | Ausnit |
| 4,785,940 | Wilson |
| 4,790,126 | Boeckmann |
| 4,846,585 | Boeckmann et al. |
| 4,892,414 | Ausnit |
| 4,894,975 | Ausnit |
| 4,909,017 | McMahon et al. |
| 4,912,616 | Van Erden |
| 4,925,316 | Van Erden et al. |
| 4,929,225 | Ausnit et al. |
| 5,007,744 | Scarberry et al. |
| 5,023,122 | Boeckmann et al. |
| 5,167,455 | Forman |

As will be described in greater detail hereinafter, the reclosable bag with offset end seal of the present invention differs from those previously proposed by providing heat sealing of plastic to plastic in the seal area, with the seal area being offset from the side end edge of the bag so that items within a reclosed bag do not cause the seal to come undone as happens with side end sealed bags, the seal area further including structure which would provide evidence of tampering, the closure not decreasing the volume within the bag and a gasket flap being provided against which product in the bag can rest, rather than resting directly on the seal and causing a failure thereof.

SUMMARY OF THE INVENTION

According to the invention there is provided a preopened reclosable bag having an offset end seal, the bag being formed from a folded over strip of plastic having one closed side edge and at least one open side edge, the strip being used to create a continuous strip of bags, each bag comprising: rectangular first and second layers of plastic, the first layer being sealed directly to the second layer along three of four edges thereof; a gasket strip lying along one open side edge of the first layer of plastic and being heat sealed along its length to the first layer of plastic to produce a first flap lying along the side edge of the plastic and a second flap extending into the bag from the seal, the gasket strip being interposed between the layers of plastic; closure means positioned along an open side edge of the second layer of plastic in a manner to allow engagement of the second layer of plastic to the second flap of the gasket strip; the side edges of the layers of plastic and the first gasket flap interposed therebetween being heat sealed together, the sealed area being scored to create a tear away tamper indicating end strip for the bag.

BRIEF DESCRIPTION OF THE DRAWINGS

FIG. 1 is a perspective view of two interconnected bags made in accordance with the teachings of the present invention.

FIG. 2 is a perspective view of one bag showing a portion of one layer thereof folded away and further showing a tamper indicating strip removed therefrom.

DESCRIPTION OF THE PREFERRED EMBODIMENT

Figure 3:
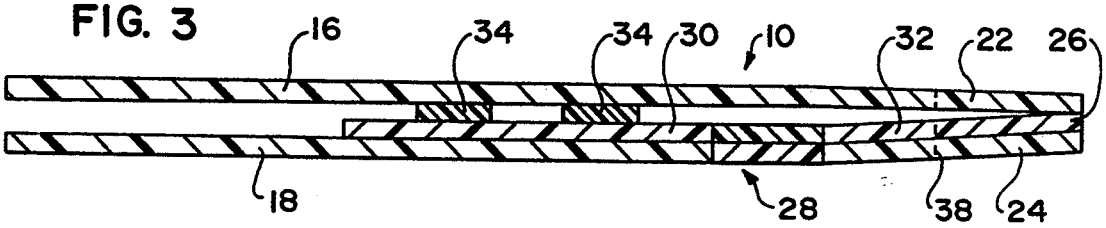
FIG. 3 is a cross sectional view through a seal area of the bag of FIG. 1.
Figure 4:
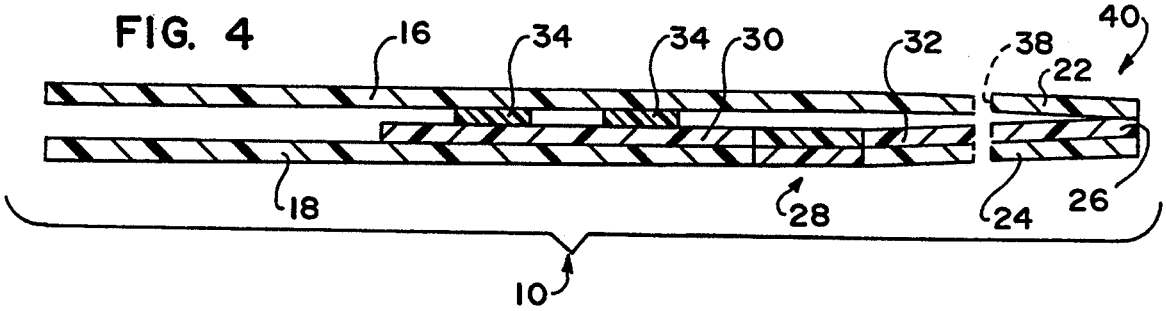
FIG. 4 is a cross sectional view showing the tamper indicating strip of the bag removed.
Figure 5:
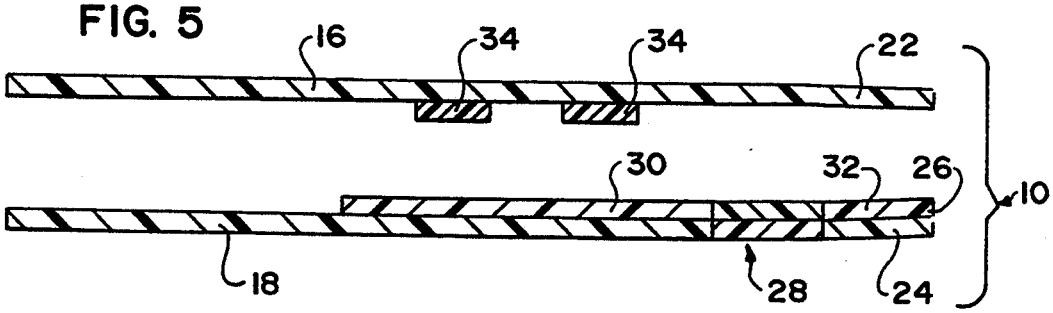
FIG. 5 is a cross sectional view showing the seal area of the bag in an unsealed condition thereof.
Figure 6:
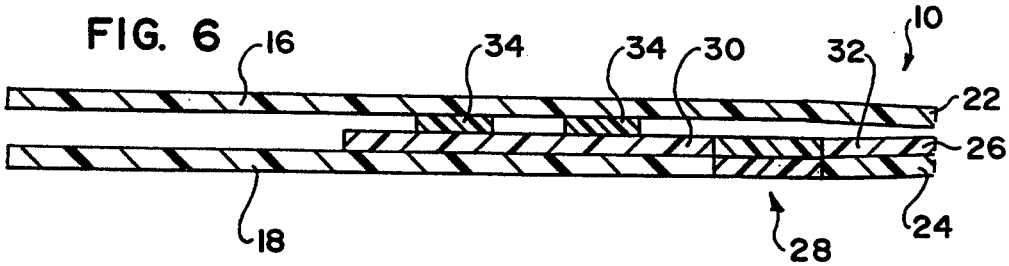
FIG. 6 is a cross sectional view showing the seal area of the bag resealed.

Referring now to the drawings in greater detail there is illustrated therein a reclosable bag with an offset end seal made in accordance with the teachings of the present invention and generally identified by the reference numeral 10.

As shown, a plurality of such bags 10 is created by automated packaging machinery (not shown) and thus requires creation of a seal toward one side edge and along a longitudinal line on the strip of bags 10.

The bags 10 area created from a single sheet of plastic 12 which is longitudinally creased at 14 to overlie itself creating two layers 16 and 18. Thus the most logical area to use for creation of a reclosable closure 20 of the bag 10 is in the area incorporated free side edges 22 and 24 of the layers of plastic 16 and 18, respectively. The bag 10 may be made of materials such as low density polyethylene; high density polyethylene; polypropylene, non-oriented; oriented polypropylene laminated to a sealing material; nylon(s) both oriented and non-oriented laminated to a sealing material; and polyester(s) coated and uncoated, to name a few.

Interposed between these free side edges 22 and 24 is a gasket strip 26 which is made of a material having a low coefficient of friction, preferably less than 0,095, and a low surface tension, preferably 36 dynes/cc or less, and being heat bondable, having characteristics of a waxy paper. In a preferred embodiment, the gasket strip 26 is made of high molecular weight, high density polyethylene, although other materials such as biax oriented polypropylene; polyester (mylar); polypropylene (cast-non-oriented); and papers and acrylics coated with heat sealing layers can also be used.

This gasket 26 is heat fused to one layer 18 of the plastic along the length thereof at a position 28 inwardly of the side edges 22 and 24 of the layers of plastic 16 and 18, creating a free gasket portion 30 or 32 to either side thereof.

Next, two spaced apart adhesive strips 34 are fixed to an inner surface 36 of the layer 16 of plastic which is not fused to the gasket 26, the strips of adhesive 34 being positioned to overly the inwardly directed flap portion 30 of the gasket 26.

The side edges 22 and 24 of the plastic layers 16 and 18 are then approximated, with the gasket flap portion 32 lying therebetween and all three layers are heat fused. A line of perforation 38 is created at an inward end edge of the area of fusion, creating a tear away strip 40 which must be removed to open the bag 10. Thus, if the tear away strip is 40 missing, it will be known that the bag 10 has been opened.

It will be understood that the bag 10 is preopened when formed from the plastic layers 16 and 18, along an exaggerated line 42, the bag 10 being blown open with a burst of air, with items to be contained therein being loaded, either manually or automatically, and the layers 16 and 18 of plastic then being heat sealed closed along the line 42, creating filled bags 10, with the strip of bags 10 being transversely scored at predetermined positions for separability.

Thus, the bag 10 is formed without need of sealing through the closure, a unique concept in bag 10 making.

Figure 7:
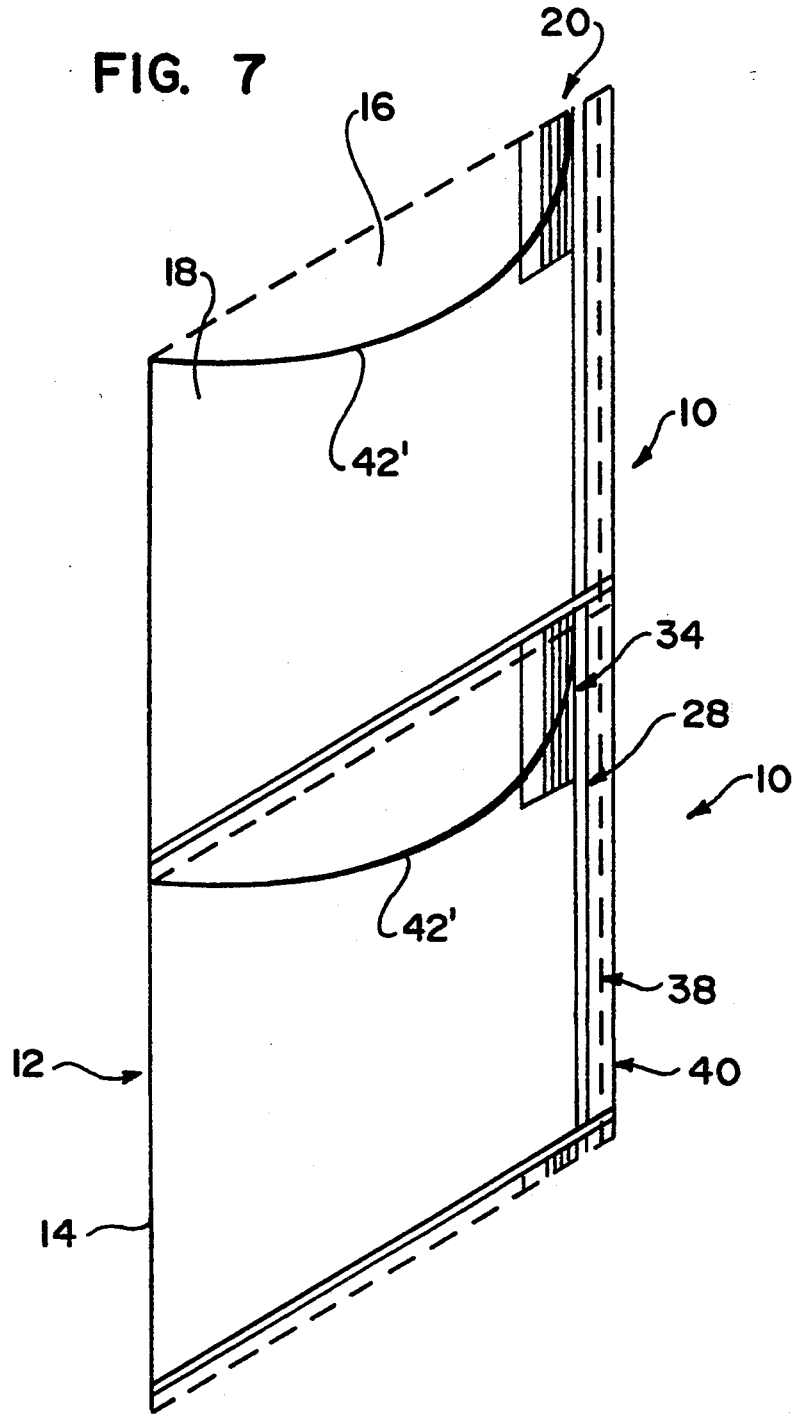
FIG. 7 is a perspective view of a further embodiment of the seal area of the bag.

Also, although the closure 20 and tamper indicating strip 40 are shown in the first disclosed embodiment as extending the entire length of the bag, this need not be construed as limiting. In this respect, one or a plurality of shorter strips may be provided, creating a pour spout type closure construction 42' as shown in FIG. 7. As described above, the bag 10 of the present invention has a number of advantages, some of which have been described above and others of which are inherent in the invention. Also, modifications may be proposed to the bag 10 without departing from the teachings herein. For example, the adhesive may be replaced with a zipper locking type element although such element tends to create a lump in the bag 10. Further, the bag 10 could be filled from any side not including the closure. Accordingly, the scope of the invention is only to be limited as necessitated by the accompanying claims.

We claim:

1. A preopened reclosable bag having an offset end seal, the bag being formed from a folded over strip of plastic having one closed side edge and at least one open edge, the strip being used to create a continuous strip of bags, each bag comprising:

rectangular first and second layers of plastic, said first layer being sealed directly to said second layer along three of four edges thereof;

a gasket strip lying along one open side edge of said first layer of plastic and being heat sealed along its length to the first layer of plastic to produce a first flap lying along the side edge of the plastic and a second flap extending into the bag from the seal, the gasket strip being interposed between the layers of plastic;

closure means positioned along an open side edge of said second layer of plastic in a manner to allow engagement of said second layer of-plastic to said second flap of said gasket strip;

said side edges of said layers of plastic and said first gasket flap interposed therebetween being heat sealed together, the sealed area being scored to create a tear away tamper indicating end strip for the bag.

2. The bag of claim 1 wherein said gasket strip is made of a material which is thermoplastic and has a low surface tension and coefficient of friction.

3. The bag of claim 2 wherein said gasket strip is made of high molecular weight, high density polypropylene in the form of a waxy paper.

4. The bag of claim 3 wherein said closure means comprise a pair of spaced apart adhesive strips engaged to said second layer of plastic and being releasably engageable to the material of the gasket strip.

5. The bag of claim 4 being made of a thermoplastic material.

6. The bag of claim 5 wherein said gasket strip has a surface tension of no more than 33 dynes/cc.

7. The bag of claim 6 wherein said gasket strip has a coefficient of friction of no more than 0.095 or less.

8. A preopened reclosable bag having an offset end seal, the bag being formed from a strip comprising two layers of plastic having one closed side edge and at least one open side edge, the strip being used to create a continuous strip of bags, each bag comprising:

rectangular first and second layers of plastic, said first layer being sealed directly to said second layer along three of four edges thereof;

at least one gasket strip lying along a portion of a fourth open edge of said first layer of plastic and being heat sealed along its length to the first layer of plastic to produce a first flap lying along the side edge of the plastic and a second flap extending into the bag from the seal, the gasket strip being interposed between the layers of plastic;

closure means positioned along a portion of a fourth open edge of said second layer of plastic overlying said gasket strip and engaging said second layer of plastic to said second flap of said gasket strip;

said fourth open edges of said layers and said first gasket flap interposed therebetween being heat sealed together, with the sealed area being scored to create a tear away tamper indicating end strip for the bag.

9. The bag of claim 8 wherein said gasket strip is made of a material which is thermoplastic and has a low surface tension and coefficient of friction.

10. The bag of claim 9 wherein said gasket strip is made of high molecular weight, high density polypropylene in the form of a waxy paper.

11. The bag of claim 10 wherein said closure means comprise a pair of spaced apart adhesive strips engaged to said second layer of plastic and being releasably engageable to the material of the gasket strip.

12. The bag of claim 11 being made of a thermoplastic material.

13. The bag of claim 12 wherein said gasket strip has a surface tension of no more than 33 dynes/cc.

14. The bag of claim 13 wherein said gasket strip has a coefficient of friction no more than 0.095.

15. A preopened reclosable bag having an offset end seal, the bag being formed from two layers of plastic and having at least three open side edges, the layers of plastic being used to create a continuous strip of bags, each bag comprising:

first and second layers of plastic, said first layer being sealed directly to said second layer on all but one side edge thereof;

at least one gasket strip having a coefficient of friction of no more than 0.095 and a surface tension of no more than 33 dynes/cc lying along a portion of an open side edge of said first layer of plastic and being heat sealed along its length to the layer of plastic to produce a first flap lying along the side edge of the plastic Layer and a second flap extending into the bag from the seal, the gasket strip being interposed between the layers of plastic;

closure means positioned along an open side edge of said second layer of plastic in a manner to allow engagement of said second layer of plastic to said second flap of said gasket strip;

said open side edges of said layers of plastic and said first gasket flap interposed therebetween being heat sealed together, with tile sealed area being scored to create a tear away tamper indicating end strip for tile bag.

* * * * *